United States Patent [19]

Ohmeis et al.

[11] 4,051,878

[45] Oct. 4, 1977

[54] ROTARY FILLER APPARATUS

[75] Inventors: Peter M. Ohmeis, Monroe; Robert L. Gehring, Sloatsburg; Roger A. Hahn, Warwick, all of N.Y.

[73] Assignee: Avon Products, Inc., Suffern, N.Y.

[21] Appl. No.: 657,695

[22] Filed: Feb. 12, 1976

Related U.S. Application Data

[63] Continuation of Ser. No. 439,533, Feb. 4, 1974, abandoned.

[51] Int. Cl.[2] ..... B65B 3/12; B65B 43/42

[52] U.S. Cl. ..... 141/82; 141/150; 141/152; 141/263

[58] Field of Search ..... 141/1, 116, 119, 129, 141/131, 135, 144–152, 177, 263, 266, 275, 324, 374, 378, 172, 82; 222/318

[56] References Cited

U.S. PATENT DOCUMENTS

| | | | |
|---|---|---|---|
| 3,040,787 | 6/1962 | Knoll | 141/146 X |
| 3,165,127 | 1/1965 | Rosenberg | 222/318 X |

*Primary Examiner*—Richard E. Aegerter
*Assistant Examiner*—Frederick R. Schmidt
*Attorney, Agent, or Firm*—Pennie & Edmonds

[57] ABSTRACT

An apparatus particularly suited for rotary filler a mold or a container such as a lipstick pomade with fatty moldable substances by an end filling technique is disclosed. A puck mold and an inverted pomade container carried thereby is conveyed to the apparatus for filling and from the apparatus once filling has been completed for further processing. The apparatus includes a rotating frame including a plurality of lift platforms for supporting the puck mold during filling. The frame includes a housing and a depending filling stem and piston assembly. The piston assembly is adapted to receive a charge of the moldable substance from a housing manifold. A valve is provided within a flow line between the assembly and the stem to open communication from the assembly to the stem and to close communication from the assembly to the manifold, and vice versa. Means are provided to control valve operation, to move the lift platform and mold upwardly to a position at which filling commences and downwardly from the position during the filling operation, and to flow the moldable substance from the piston assembly to the filling stem. The various functions are properly coordinated to the rotary movement of the frame.

2 Claims, 11 Drawing Figures

10
12
14
16
18
20
22
50
72
74
76
78
80
100
101
IA
IA

ROTARY FILLER APPARATUS

This application is a continuation of application Ser. No. 439,533, filed Feb. 4, 1974, and now abandoned.

The present invention relates to a filling apparatus of the rotary type intended to deliver fluid in accurate measured volume to a container.

BACKGROUND OF THE INVENTION

The prior art is replete with apparatus for filling containers with a fluid material as the containers are rotated about a fixed axis. Generally, one or more plunger nozzles are moved toward and into contact with or in proximity to the rim of the rotating mold or container which is to be charged with fluid material. The material flows either by gravity or under a forced pressure. A fluid indicator measures the volume of material delivered to each container.

Apparatus of this type has been subject to certain problems and disadvantages. Among these are problems arising during filling, namely the tendency of the nozzle which depends to or is moved into proximity with the rim of the container or mold, sealing the same during filling. The result may be internal container or mold pressurization and agitation of the material therein. If the material is of a somewhat viscous nature having a tendency to set-up when delivered from heated to cooler ambient surroundings the agitation with set-up may militate against proper settling of material. Further, the viscous filling material may tend to entrain or trap air within the container or mold as the filling operation is carried out. Neither of these occurrences may be tolerated in the processing of lipstick pomades having as one requirement a smooth, aesthetically attractive outer surface.

A further problem and disadvantage resides in the manner and means to control the flow of material thereby to introduce an identical charge to each mold or container. To this end it is necessary and required that each container be charged with no less than a specified volume.

Other problems and disadvantages of like concern although not discussed hereafter are recognized in connection with other prior art forms of filling apparatus.

BRIEF DESCRIPTION OF THE INVENTION

The filling apparatus of the present invention comprises an improvement over the known filling apparatus of the rotary type. To this end the apparatus is capable of filling accurately a mold or container with a hot viscous substance, which solidifies upon cooling, to produce a product substantially devoid of imperfections on and within the molded substance.

In one aspect, the present invention provides a filling apparatus of the rotary type for filling the cavity of a puck mold in the manufacture of lipstick pomades. The apparatus includes a module comprising a cylinder to be charged with material, a filling stem through which the material from the cylinder is expressed, and a valve to communicate the cylinder to either the filling stem or a manifold through which material is continuously flowing. The operation of the module is controlled by cam means and an intercooperating cam follower means. To this end, the cylinder is charged, the puck mold is moved to a commence filling position and from the position during filling, and the valve operates to open communication to the cylinder for changing the same and from the cylinder for filling the puck mold at controlled times during the rotary fill cycle.

In a second aspect, the present invention envisions a plurality of modules adapted for rotation about an axis. The cam means is in the form of an annulus around the modules so that as the modules rotate individually they will be in various stages of operation within an operative cycle.

In a further aspect, the present invention envisions a manifold in communication with each module and providing a continuous flow of product therethrough. The independent sequential operation of each module is timed so that at any one time approximately one-half of the modules are undergoing and within various stages of changing while approximately the other one-half of the modules are undergoing and within various stages of filling.

There has thus been outlined rather broadly the more important features of the invention in order that the detailed description thereof that follows may be better understood, and in order that the present contribution to the art may be better appreciated. There are, of course, additional features and aspects of the invention that will be described hereinafter and which will form the subject of the claims appended hereto. Those skilled in the art will appreciate that the connection upon which this disclosure is based may readily be utilized as a basis for the design of other structures for carrying out the several purposes of the present invention. It is important, therefore, that the claims be regarded as including such equivalent constructions as do not depart from the spirit and scope of the invention.

DESCRIPTION OF THE DRAWING FIGURES

The accompanying drawings form a part of the present application. By these drawings, which illustrate a preferred form of the invention, FIGS. 1A and 1B are a schematic form representation of a layout for processing lipstick pomades and including the rotary filling apparatus of the present invention;

The present invention is particularly directed to the processing of lipstick pomades and to a filling apparatus for use in the line. The process may be best considered through the schematic illustration of FIGS. 1A and 1B. In the Figures the process is illustrated by the presentation of various operative stations through which sequentially a puck mold and lipstick pomade container are conveyed. By means of the present system including the filling apparatus product in an amount equal to approximately 200 or more lipstick pomades per minute may be manufactured.

Figure 1A:
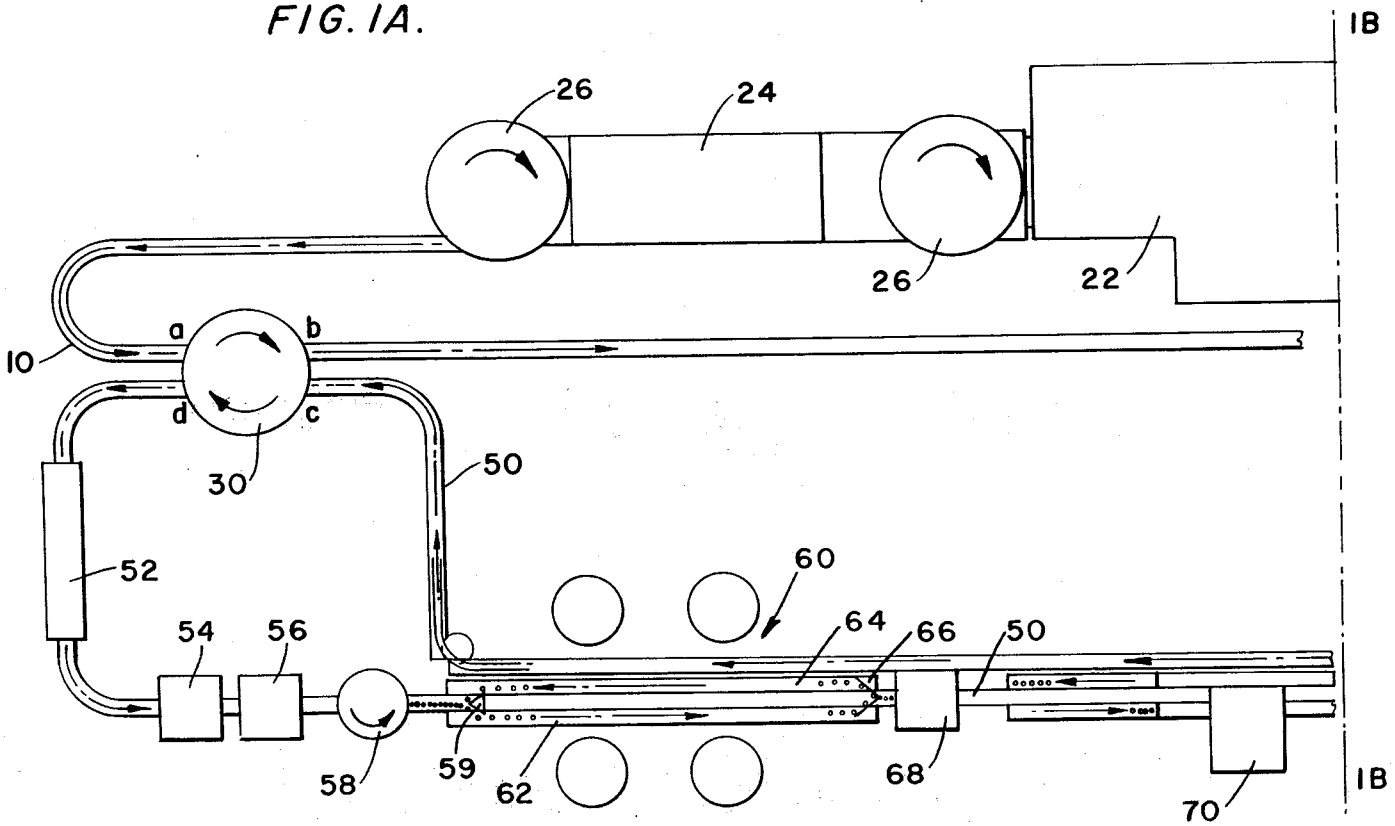
Figures 1B, 2:
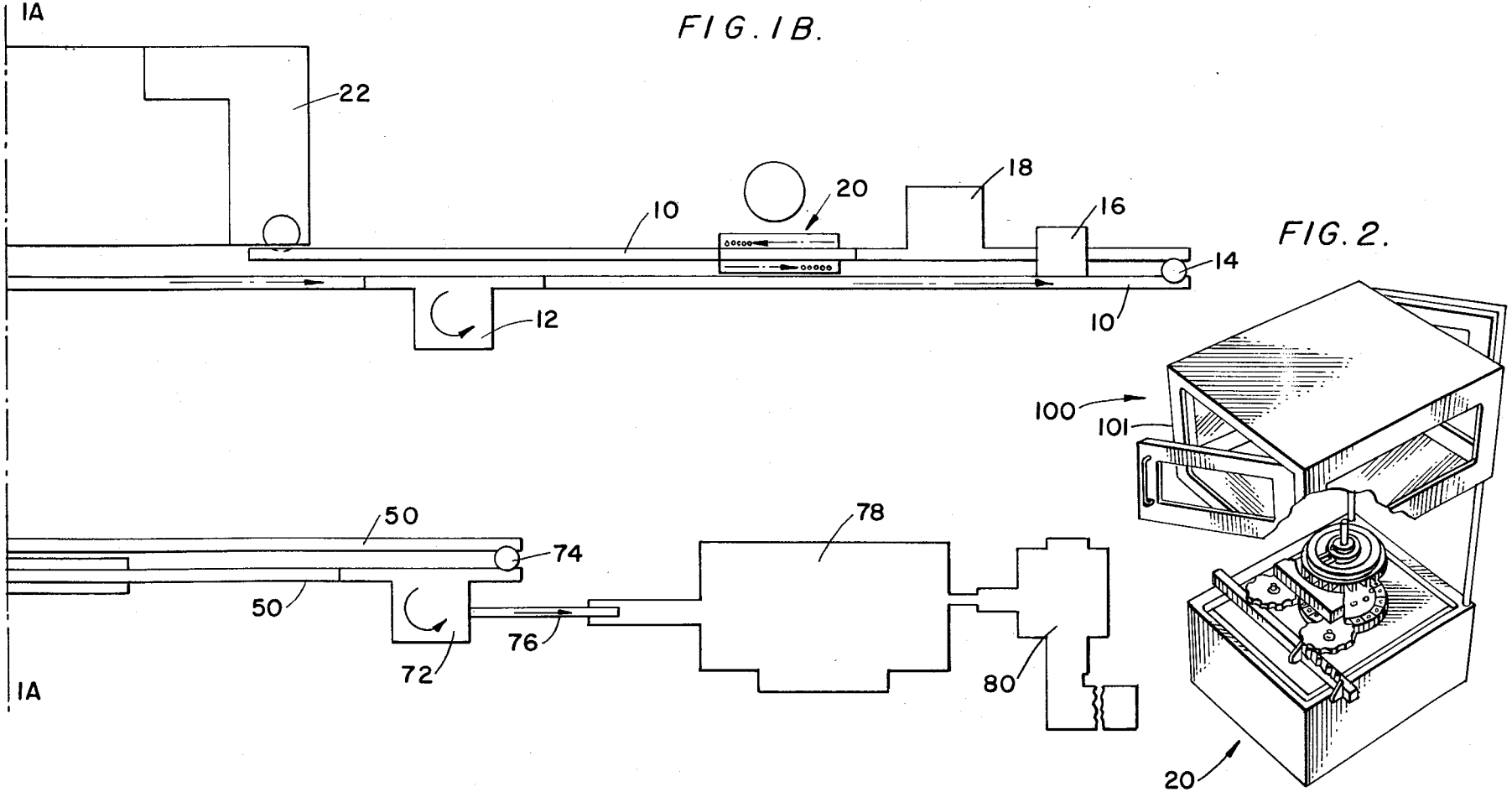
FIG. 2 is a view in perspective of a heated enclosure with a portion of the side wall broken away so that the rotary filling apparatus in general outline may be viewed.

With reference to FIGS. 1A and 1B, a continuous supply of puck molds is moved along an endless conveyor 10 from a rotary extractor device. The puck molds, traveling towards the right in the Figures in the direction of the arrows, will have been emptied of the lipstick pomade container which was carried thereby through the filling and stations which follow. Thus, the puck mold will arrive at a container placement station, denoted by the number 12, interposed within the path of the puck mold from the rotary extractor in condition to receive a further lipstick pomade container. By means of suitable apparatus a lipstick pomade container including an inner swivel component is received by the puck mold for movement with the same. The lipstick pomade container will be received by the puck mold in the top down position. The puck molds may be of a size of from approximately 0.50 to approximately 3.25 inches in diameter. The size of the puck mold in the rotary filler apparatus is not as critical as would be the size requirement in a straight-line filler apparatus.

The conveyor includes a turn around 14 for commencement of traverse in the opposite direction. The puck mold together with the container is conveyed to a swiveler station 16. Apparatus capable of operating on the swivel mechanism of the inner component is disposed at station 16. The swiveler functions to position or swivel the inner component to the lipstick pomade extending position. Since the container is in the top down position the swivel mechanism may easily be grasped by the operation structure and movement of the component to the desired position is easily attained. Following this operation, the puck mold and lipstick pomade container is received at the cleaning station 18. The operation at station 18 is carried out to ready the structure being conveyed for filling.

The specific structure comprising the swiveler, the cleaning apparatus and certain other structural components which will be referred to hereinafter in the discussion directed to the further processing steps, including the labelling and coding, flaming, etc. will not be described in any detail within the present disclosure. To this end, while the structure is important in the overall system it may be considered as conventional in the art for purposes of the present discussion directed primarily to the filling apparatus of rotary type.

The filling operation ensues at station 20. The filling apparatus and the manner of operation will be specifically described in connection with FIGS. 3–8, as the description directed to the preferred embodiment thereof continues.

The filled container next is passed into a cooling tunnel 22. To this end, the moldable material which is dispensed into the puck mold at an elevated temperature and in a flowable form is exposed to cooling air which is passed over and around the mold and the pomade material therein. The puck mold may be received within the cooling station after only a few seconds of time following receipt of a charge of material. For example, the puck mold may be received within the cooling tunnel in about 6 seconds whereby the material will commence set-up to a greater extent. The puck mold will have been routed from the conveyor 10 for movement through the cooling apparatus.

A labelling and coding station 24 follows. Labelling and coding may be accomplished by utilization of a plurality of rotary devices 26, only two of which are shown. More particularly, the rotary devices operate in tandem and move their proportionate share of puck molds through generally an S-shaped path and again dispose the puck molds on the conveyor 10. The labelling and coding operation is carried out during movement within the path. Suitable apparatus for application of a label to the bottom of the container body to cover the filling hole may be employed.

A third rotary device may be provided at the labelling and coding station. This device may be maintained in reserve to permit maintenance as may be required or desired to be carried out on one of the active devices without requiring shut-down of the line. To this end, the puck molds, by means of suitable shunt apparatus on the cover exiting the cooling chamber, may be directed in any path toward an operative labeller.

The following stations of the process call for positioning of the container in the upright position. The lipstick pomade will be extended. To this end it is to be recalled that the lipstick pomade is formed in the puck mold under the condition of the inner component having first been rotated to the extended position through action of swiveler 16. A rotary extractor 30 is disposed in the conveyor path to achieve the desired positioning of the container.

The rotary extractor may be a device such as disclosed in co-pending application Ser. No. 242,337, filed Apr. 4, 1972, now U.S. Pat. No. 3,797,683, of Mar. 19, 1974, and assigned to the Assignee of the present invention. Reference may be had to that application for a specific discussion as to the particular operation of the rotary extractor.

For the present let it suffice to say that the rotary extractor functions to extract the lipstick pomade from the mold by movement of the lipstick pomade in the vertical direction relative to the mold through rotation from point *a* to *b.* Thus, the empty puck mold is in condition to return on conveyor 10 to receive a further container at 12. Between points *a* and *b* the lipstick pomade container is rotated through 180° so that at point *c* the lipstick pomade container will be properly oriented and disposed in position to be received in an empty puck mold travelling toward the rotary extractor on conveyor 50. The movement of the empty puck mold is timed to the movement of the lipstick pomade container so that between points *c* and *d* the lipstick pomade container is lowered for travel with the puck mold. The rotary extractor may include a pair of fingers for gripping the lipstick pomade container. The gripping fingers may be raised, lowered and rotated relative to a puck mold by any particular means.

The puck mold and container with lipstick pomade in the extended position is conveyed through a flamer 52. Within the flamer the pomade material receives a lustrous sheen and surface irregularities, or imperfections are removed. Thereupon the mold and lipstick pomade container is conveyed through a pair of swiveling devices 54, 56 located in tandem. In the first swiveler the inner component and the lipstick pomade is swiveled downwardly to a retracted position; whereas in the second swiveler the inner component is swiveled upwardly so that the lipstick pomade is extended once again.

An inspection station follows. The inspection station includes an accumulator 58 which receives containers passing from the swiveler 56. The accumulator provides for metered exit of containers toward a gate 59 which divides the puck molds and lipstick pomade containers into alternate columns for movement through the inspection station 60. To this end, the gate 59 is disposed over the conveyor 50 which moves between a pair of laterally spaced conveyors 62, 64. Inspectors may be positioned on either side of the conveyors.

The conveyors 62, 64 are formed by endless movable belts trained about a pair of spaced pulleys, one of which may be driven. The conveyors 62, 64 may be driven at a slower speed than is the conveyor 50 to permit the inspectors to carry out their quality control functions.

A surface 66 inclined toward the conveyor 50 is disposed at the downstream end of each of the conveyors 62, 64. The surface causes each puck mold and the lipstick pomade container to return again to the conveyor 50.

A further swiveler apparatus 68 is disposed within the line downstream of the inspection station. The swiveler serves to retract the inner component and the lipstick pomade to the interior of the container for further processing operations. To this end a cover is received by the container at the placement station. The covered container thereafter moves toward a station 72 at which the cover and base is assembled and the lipstick pomade container is withdrawn from the supporting puck mold. The station 72 may also function to place a base button or base cap on the lipstick pomade container after withdrawal from the puck mold. The empty puck molds continue their travel on conveyor 50 to a turnabout point 74 at which the puck molds begin their traverse in the return direction toward the rotary extractor 30 to receive a further lipstick pomade container.

The production line which has been generally described is capable of continuous operation and, as indicated, product at a rate of approximately two hundred or more lipstick pomades per minute may be formed.

The filling station 20 includes structure now to be discussed. The apparatus is disposed within an enclosure 100 as seen in FIG. 2. The enclosure includes a window portion 101 which is movable between a lowered and a raised position for access to the filling structure. The enclosure and window portion surrounds the filling structure. The enclosure includes an entry and an exit (not shown) for the conveyor. As will be described in detail below, continuous flow of moldable material at an elevated temperature is moved into, through and out of a filling manifold which, by means of a valve, is in communication with each of several filling cylinders. Thus, upon valve movement a portion of the flow is diverted for the purpose of charging the cylinders sequentially. Upon command, a transfer of material from the cylinder to the puck mold is carried out. This operation is dependent upon valve actuation. A plurality of quartz lamps or other suitable heating means (not shown) may be provided within the enclosure to maintain the material at the elevated temperature.

The filling apparatus may best be seen in FIGS. 3–8. The filling apparatus generally includes a filling or charging cylinder 102, a filler assembly 104, and a valve 106 interposed between a manifold passage 108 and each cylinder and filler assembly. The valve may be of spool construction and capable of moving rotationally about its axis through an angle of approximately 120°. Thus, in one limit position the valve will communicate the passage 108 and cylinder 102 while in the other limit position the valve will communicate the cylinder 102 and the filler assembly 104. The valve throw of approximately 120° reduces air entrapment.

Both the charging cylinder and the filler assembly are supported by a housing member 110 which in turn is supported by a manifold 112. The housing and the manifold each are formed with an annular semi-circular cut-out which upon receipt of the housing on the manifold, and in alignment one with the other, form the passage 108. The charge continuously flows through the manifold to permit controlled by-pass to individual charging cylinders. The enclosure retains the heat from the quartz lamps to maintain the elevated temperature of the pomade material and permit continuous flow.

Figure 7:
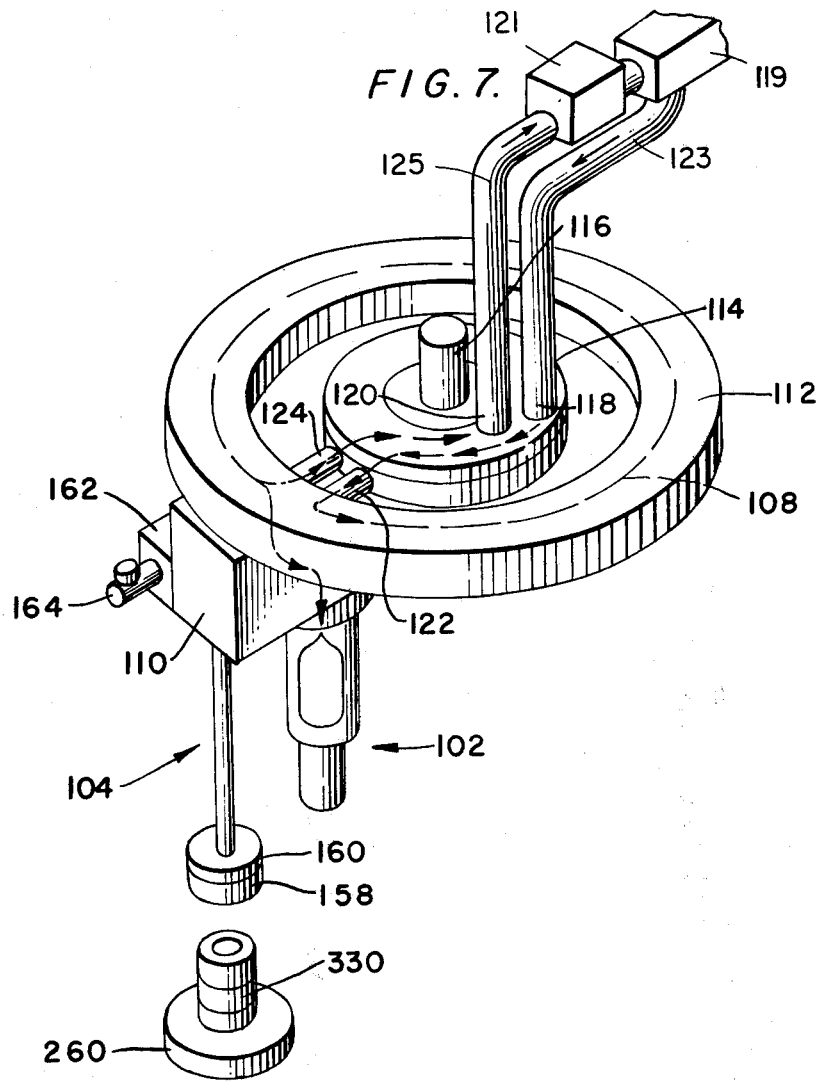
FIG. 7 is a perspective view of the product flow manifold of the rotary filling apparatus illustrating a continuous flow of material and by-pass to the piston cylinders (only one shown) for charging the same.

Referring to FIG. 7, the passage 108 is in communication with both an inlet to and an outlet from the manifold. The manifold is in the form of an annulus surrounding an inner plate member 114. The plate is attached to a shaft 116 which is caused to rotate at a predetermined angular speed. The plate may be provided with a pair of internal passages. A first passage communicates with an inlet 118, while a second passage communicates with an outlet 120. The inlet 118 and outlet 120 are in fluid communication with a reservoir 119. To this end, a delivery conduit 123 connects with the inlet and a return conduit 125 connects with the outlet. Either conduit may include a pump 121 for purposes of maintaining the flow of pomade material into and out of the manifold 112 continuous. The material is flowed into the manifold passage 108 through the inlet 118, the internal plate passage and connector 122. A portion of the material is diverted for charging sequentially the charging cylinders, only one of which is shown for reasons of clarity. Moldable pomade material which continues thrugh passage 108 returns to outlet 120 by way of connector 124 and the plate passage. The tendency of the pomade material setting up within the line will be obviated through maintenance of the material at the elevated temperature. A continuous flow will reduce the tendency of material to settle.

The plurality of housings are spaced equidistantly around the manifold. Each housing is connected to the manifold by an annular plate 126. Connection may be by means of a pair of self-locking bolts 128 received through the plate and housing on opposite sides of the manifold. The manifold, in turn, is connected to the plate by the bolts 129. Release of the bolts 128 permits release of the cylinder, valve and filler assembly of each module for cleaning and/or replacement of individual components, as is necessary.

The housing includes an opening extending between the sides. The valve 106 generally of spool form is received for rotation within the opening. The valve is adapted for rotation through an angle of approximately 120° thereby in one limit position to communicate the passage 108 to the cylinder 130 of the charging cylinder 102. Particularly, communication between the passage and the cylinder is provided by means of a bore 132 extending through plate 126 and housing 110, bores 134, 136 within the valve body, bore 138 in the housing, and bore 140 formed in the cylinder adapter 142. O-rings 146, 148 are disposed around the bores in disposition between the annular plate 126 and housing 110 as well as in disposition between the housing 110 and cylinder adapter 142, respectively. The O-rings provide a seal to prevent leakage of pomade material from the bores.

Figure 3:
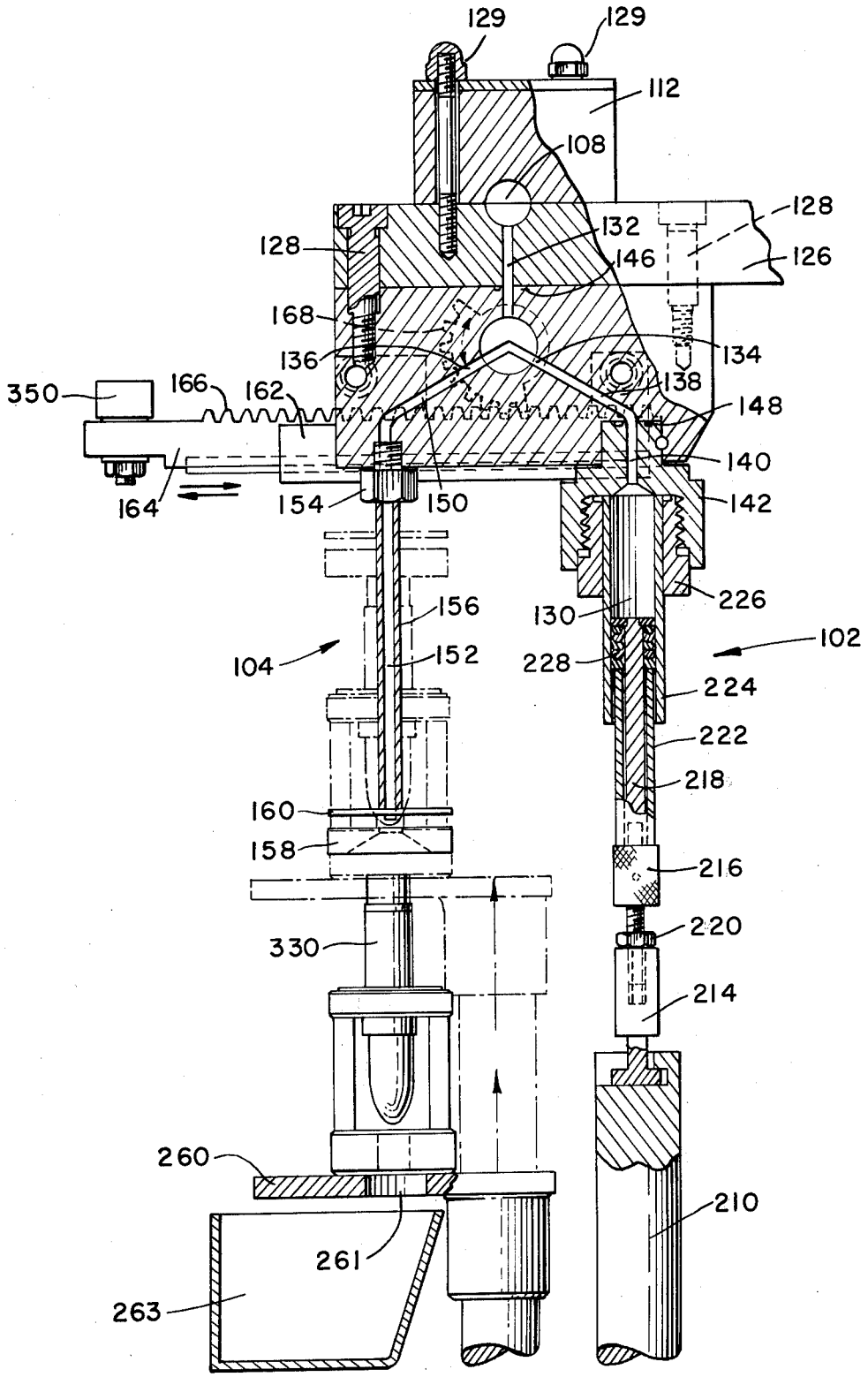
FIG. 3 is a view in elevation, and partially in section, of the rotary filling apparatus.

Movement of the spool valve to the position illustrated in FIG. 3 communicates the cylinder 130 to the filler assembly 104. To this end, the bore 134 in the spool valve communicates with bore 138 while the second bore 136 communicates with a bore 150. The bore 150 is in direct communication with the filling stem 152 through the coupling 154. The filling stem is supported with a depending guide bar 156. A centering ball 158 and a spaced guide plate 160 are carried by the guide bar and movable therealong, as will be fully described below.

Figure 4:
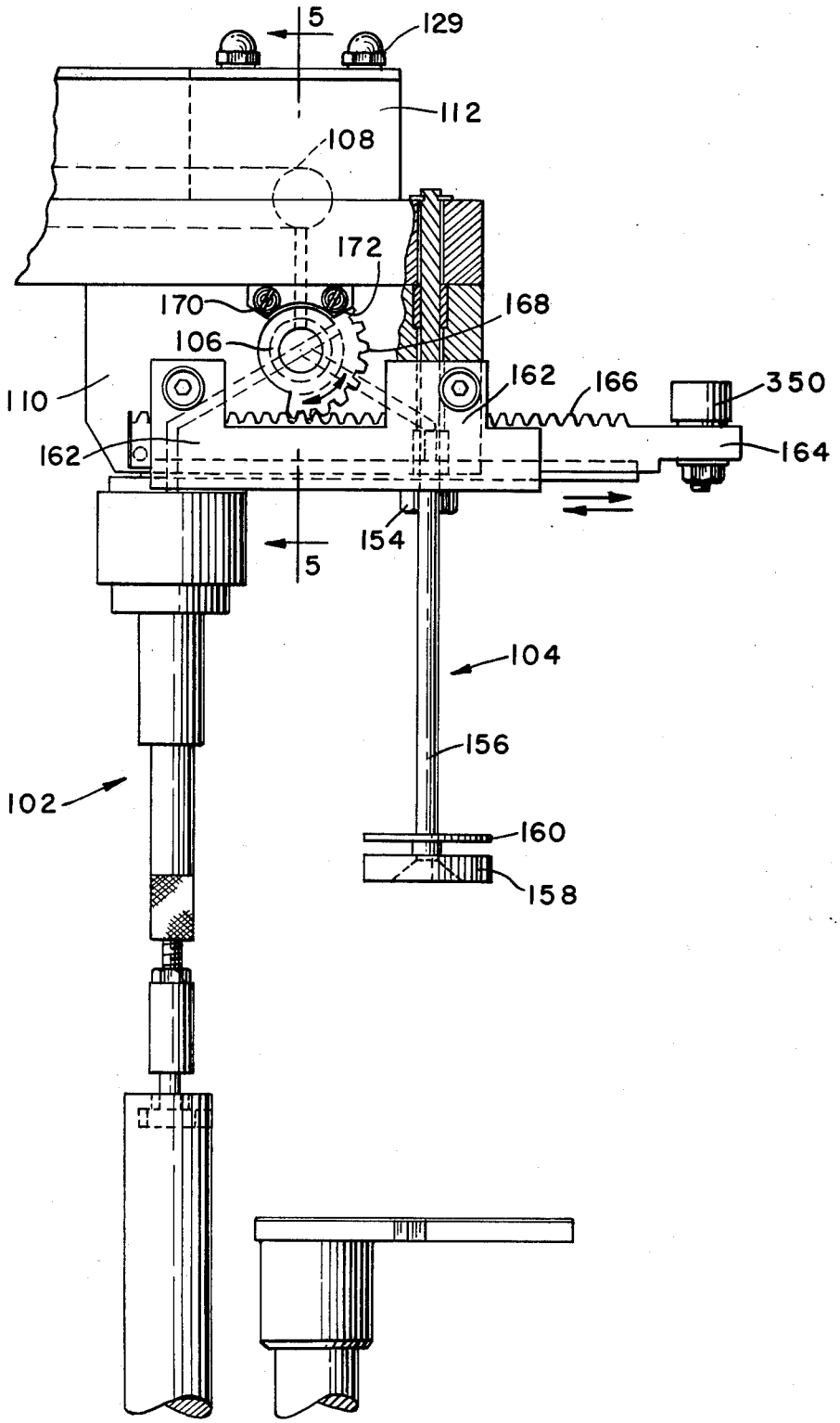
FIG. 4 is a view similar to that of FIG. 3 yet illustrating the opposite side of the rotary filling apparatus.
Figure 8:
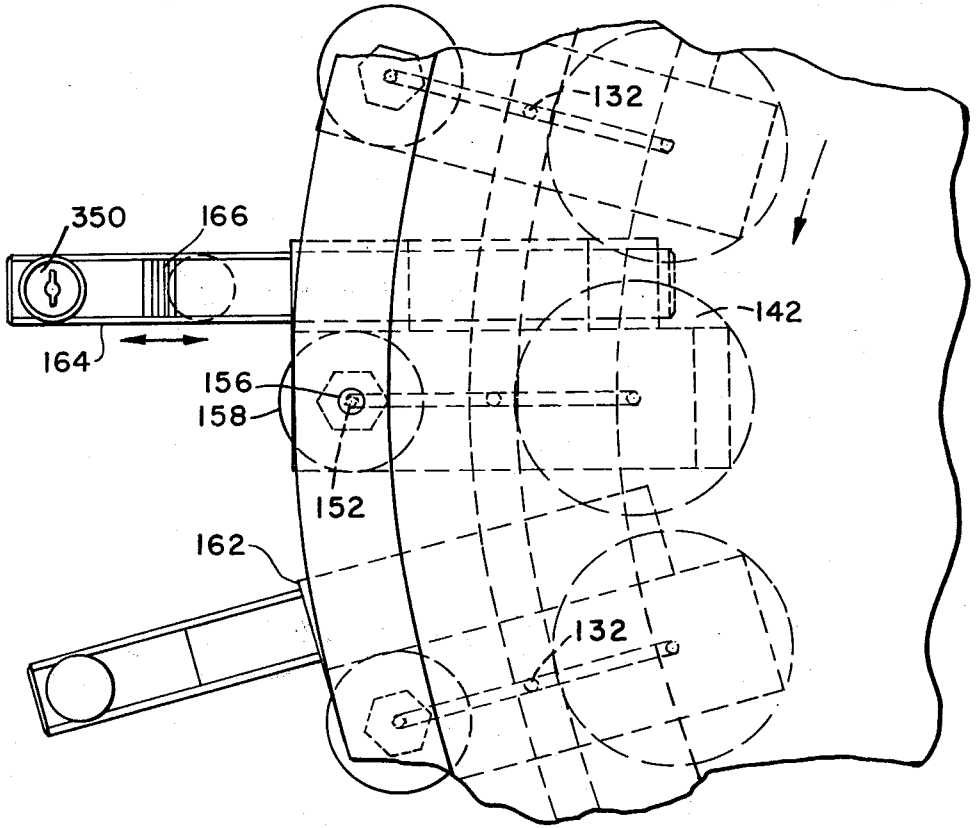
FIG. 8 is an enlarged top plan view of a portion of the product flow manifold of FIG. 7 illustrating the operating structure for moving a rotary valve between a cylinder charging position and a filling position.

As may be seen in FIG. 7, a valve actuator housing 162 is positioned laterally of the housing 110. The housing 162 provides support for a rack 164 which is movable in the directions of the arrows in FIGS. 3 and 4. The rack provides a plurality of teeth 166 along its upper surface. The valve 106 also provides a plurality of teeth 168 which cooperate with the rack teeth 166. Accordingly, movement of the rack toward the left in FIG. 4 will cause movement of the valve toward the stop 170. Movement of the rack in the other direction will cause the valve to move toward the stop 172. As is illustrated in FIG. 4 both the actuator housing and the stop member are bolted or otherwise secured to the housing 110.

Figure 5:
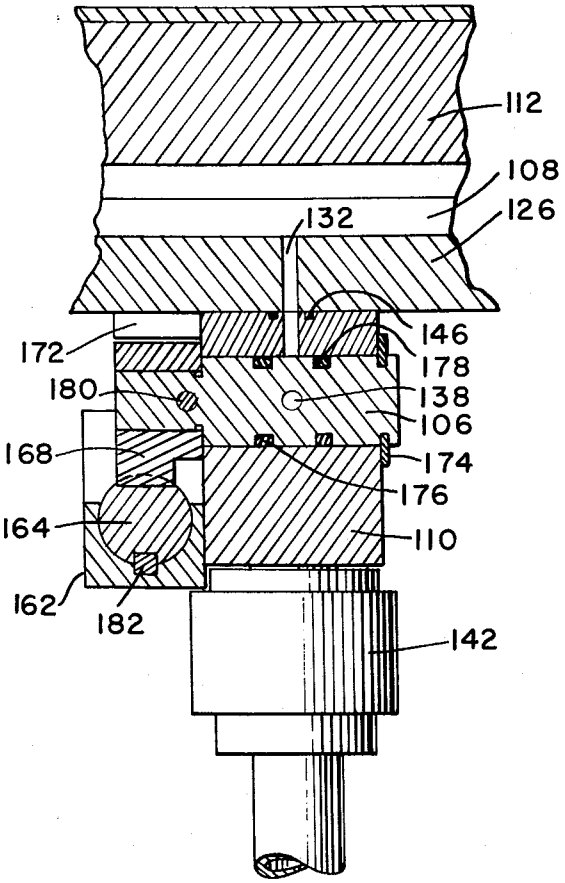
FIG. 5 is a sectional view as seen along the lines 5—5 in FIG. 4.
Figure 6:
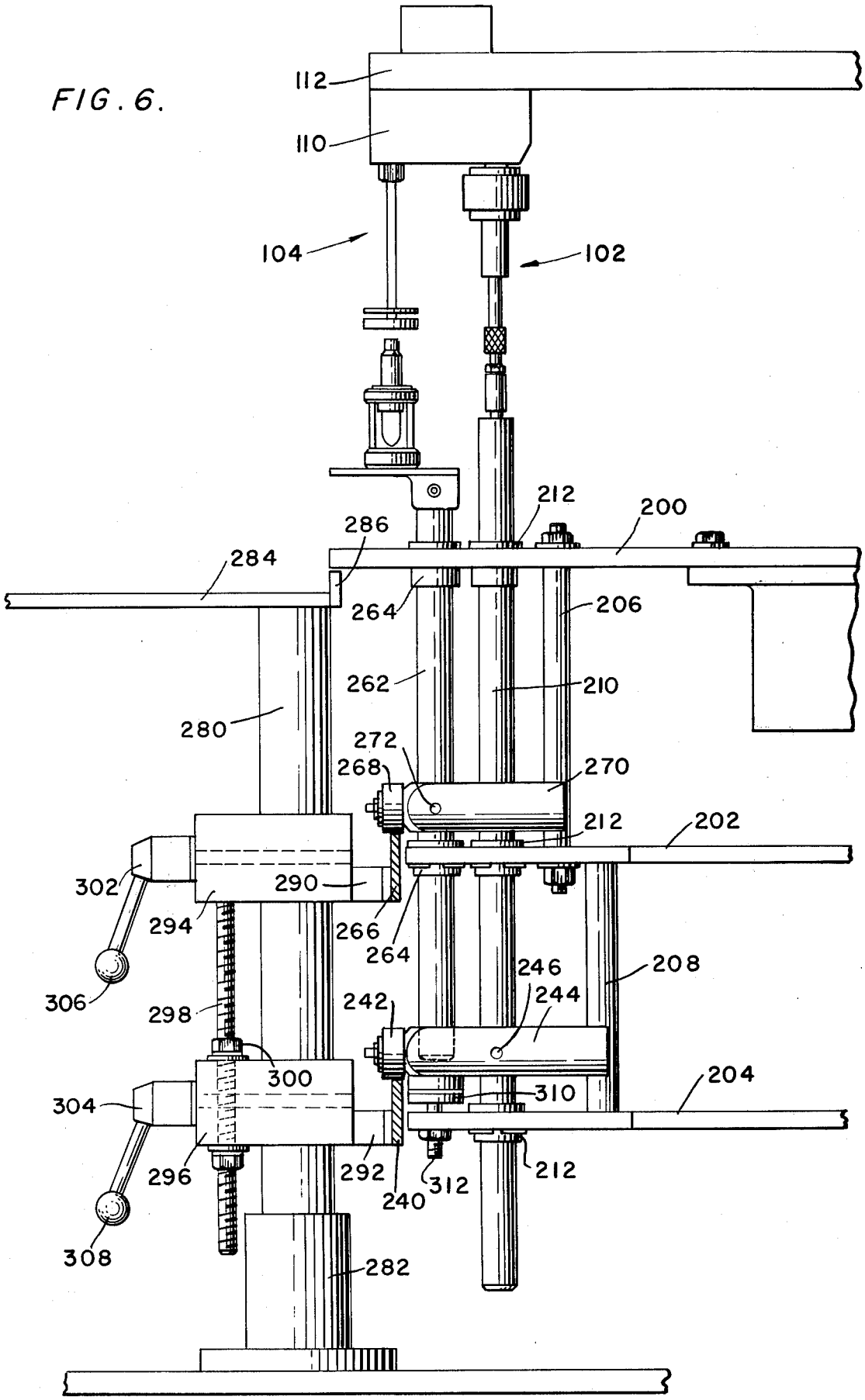
FIG. 6 is a view in elevation of operating structure for raising a puck mold to a filling position and actuating a piston to express moldable material to the mold cavity.

The arrangement of structure may be seen to better advantage in FIG. 5. Referring to that Figure, the valve 106 carrying the gear teeth 168 on one end extends through the housing 110. The valve may be secured by a retainer ring 174 intercooperating with an annular cut-out in the valve and the housing wall.

A pair of O-rings 176, 178 are positioned around the valve. Preferably, the O-rings are disposed on opposite sides of the bores to assist in sealing the flow passages and confining the flow of pomade material.

The gear 168 may be secured to the valve 106 by any particular means such as a pin 180. The valve may also have the gear teeth formed on the outer periphery in a manner as is well known in the art. A track 182 carried by the actuator housing supports back and forth rack movement.

The filling operation is carried out during controlled rotary movement of the housing 110 within a stationary frame. More particularly, the stationary frame carries a plurality of cam tracks having a predetermined surface contour. These cams and intercooperating cam followers cause a charge and discharge of the charging cylinder, the raising of the puck mold to a filling position and the descent of the same during filling, and valve movement to communicate the cylinder with either the manifold or filler assembly. Each module including a charging cylinder, filler assembly and valve is operated independently of other modules of the rotary filler. For example, if the rotary filler incorporates a plurality of fourteen modules equidistantly spaced around the shaft 116, approximately half of the modules under control of the cam track means may be undergoing stages of filling of the cylinders 130 while approximately the other half of the modules under control of the same cam track means may be undergoing stages of filling of the puck molds. In this manner, the continuous flow of pomade material may be maintained more uniform in that there is no requirement for filling all cylinders at one time.

The apparatus of FIGS. 3 and 4 is supported by, for rotation about, the shaft 116. The shaft 116 also supports each of the plate members 200, 202 and 204 for rotation. The plates are supported in horizontal spaced relation on the shaft. The plates may be keyed or otherwise secured to the shaft. A plurality of columns 206, 208 are secured between the plates 200, and 202, and plates 202 and 204, respectively. The columns maintain proper spacing at the periphery. The columns may be arranged equidistantly and in an annulus around the shaft. Connection may be by any convenient means. A shaft 210 is supported by the plates for vertical reciprocal movement. The bearing members 212, carried by several plates, assist in ease of movement. Upon reciprocation of the shaft and piston, through connection means to be discussed, in the upward direction the charge of lipstick pomade material within the cylinder is expressed to the filling stem. Movement of the piston is timed to valve movement. Slight movement of the shaft and piston in the downward direction creates a vacuum condition in the cylinder to first "suck" material disposed in the line after filling into the cylinder and thereafter, upon further movement following valve repositioning to complete filling through communication of the cylinder and manifold. Thus, the cylinder is charged for filling a further puck mold.

The shaft 210 is connected to the piston by means of a coupling 214 interposed between the shaft and an adjusting nut 216 at its lower end. The length of the stroke of the piston may be adjusted by suitable adjustment of the nut 216 which may then be immobilized by a lock nut 220. A bearing sleeve 222 which reciprocates within the cylinder 224 provides freedom of movement of the piston shaft. A holder 226 surrounds and supports the piston cylinder at the upper end. The holder is attached to cylinder adapter 142. The cylinder is sealed by means of a plurality of C-V rings 228 which surround the piston shaft between the piston and the bearing sleeve. The cylinder and piston are disposed in a vertical orientation. The orientation is helpful in obviating against air entrapment within the pomade material. This results in fewer pin holes in the lipstick pomade. Further, the vertical disposition of structure has the beneficial effect of reducing wear of moving parts which is contemplated with extreme side contact of piston and cylinder wall.

The shaft 210, through intercooperation with a cam 240 and cam follower 242, may be reciprocated in the vertical direction, as described. The cam follower is supported at one end of a yoke 244. The legs of the yoke pass on opposite sides of the shaft 210 and are secured by pin 246. The other end of the yoke is supported by column 208.

Cam 240 provides an upper track which is contoured in coordination with the contour of other cam tracks so that filling of the puck molds and charging of the cylinder may be carried out at a timed rate.

The puck mold is supported by a plate 260 fixed at one end to a shaft 262. In a manner similar to the mounting of shaft 210 the shaft 262 is supported for movement relative to the plates 200, 202 and 204 by cylindrical bearings members 264 received by plates 200 and 202.

The support plate carrying the puck mold is moved upwardly to a commence filling position and downwardly from that position as filling of the puck mold once started continues. Movement of the support plate is carried out at a timed rate through the intercooperation of a cam 266 and cam follower 268. The cam follower 268, likewise, is supported at one end of a yoke. The yoke 270 formed by a pair of legs extending on opposite sides of the shaft 262 is secured to the same by a pin 272. The other end of the yoke is supported for movement along the column 206.

The cam members 240 and 266 are annular in form and extend around the shaft 116. Both of the cam tracks are adjustable in height. To this end, a shaft 280 is supported in the vertical position by a stationary frame structure of the filling apparatus. The shaft includes a base 282 and an upper plate 284 carrying an upstanding flange 286. The flange may serve as a bearing support for plate 200. Each of the cams 240 and 266 is carried by an extension 290, 292 of height adjustment block or clamp shoe 294, 296 respectively. The height adjustment blocks are individually adjustable on a threaded shaft 298. The adjustment nuts 300 retain the position of adjustment. A structure 302, 304 and handles 306, 308 assist in the adjustment movement. This height adjustment serves to adjust the operation of each module as may be accommodated within the annulus of the rotary manifold 112. Individual pistion fill adjustment may be carried out by adjustment of the member 310 carried on threaded shaft 312.

The puck mold support plate 260 includes an opening 261. A drain tray 263 may be disposed below the opening to receive material discharge during cleaning. The drain tray may include heating means (not shown) to maintain the material in a flowable form.

Figure 9:
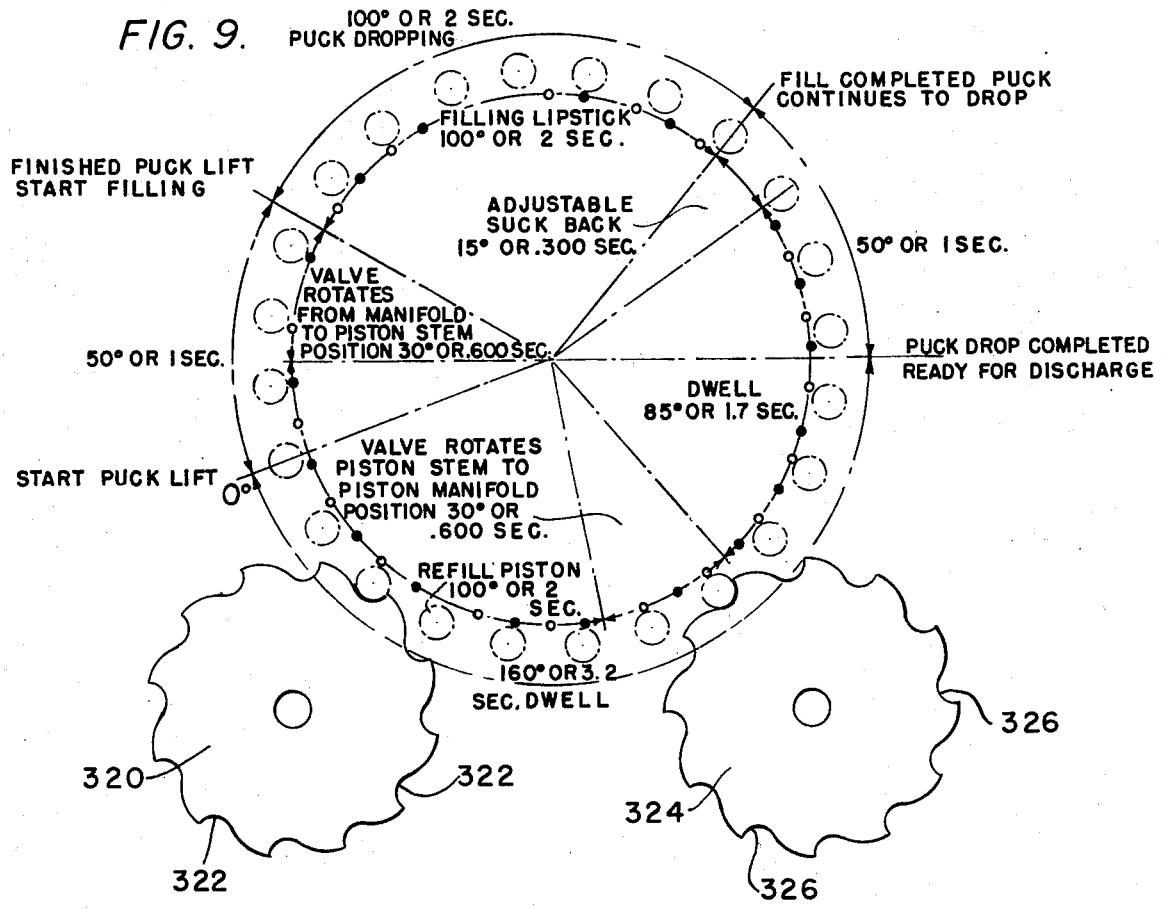
FIG. 9 is a rotary filler cam program illustrating the duration of and rotational frame position at the commencement of the several operations; and, FIG. 10 is a further illustration of the program operations and the positioning of the puck mold during the same.

Operation of the rotary filling apparatus as is illustrated in FIGS. 2–8 should now be evident from a reading and understanding of the above description. The filling operation is carried out as one operative function of the process discussed in overall view in connection with FIGS. 1A and 1B. Thus, the filling operation envisions the receipt of individual puck molds and lipstick pomade containers carried thereby at the filling station 20 upon movement of the conveyor 10. A first wheel 320 (FIG. 9) is disposed between the filling apparatus and the conveyor. The wheel includes a plurality of pockets 322 spaced equidistantly around the periphery. The puck molds are received within the pockets and moved from the conveyor to the support plate 260, comprising one of a plurality of support plates, as the latter are rotated. Once filling has been contemplated and the plate 260 has completed substantially a full rotation, the puck mold is received within one of a plurality of pockets 326 in a second wheel 324. The second wheel returns the puck mold to the conveyor for further operations, as already discussed.

Figure 10:
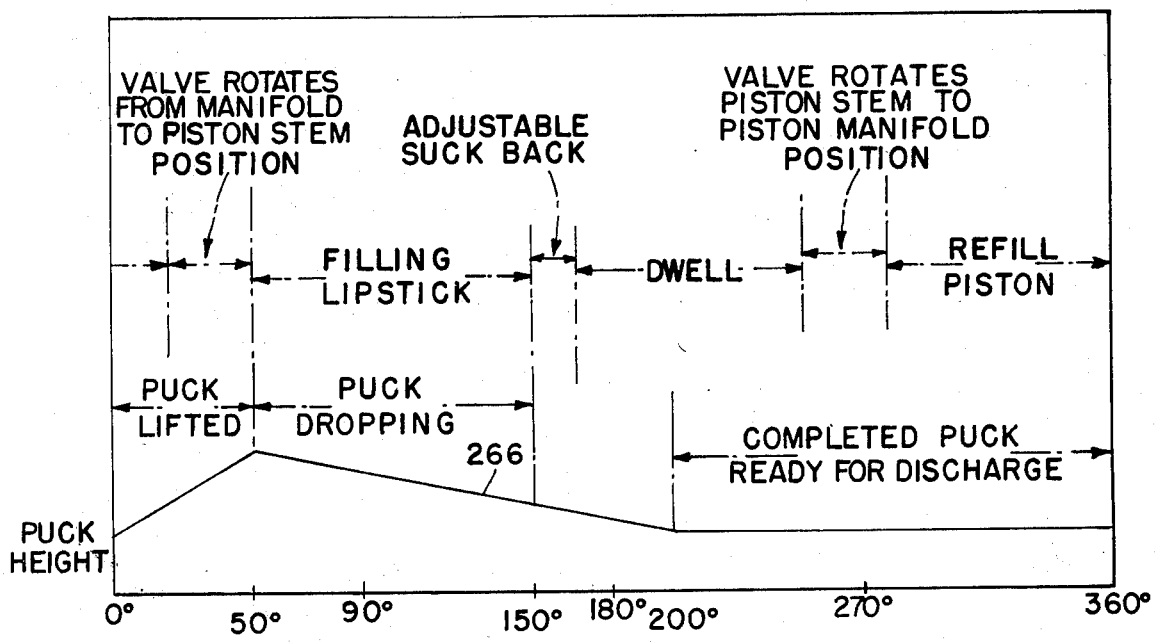

The puck mold and support plate 260 is raised gradually (see FIG. 10) from the lower to the dotted line position as illustrated in FIG. 3. Movement to the dotted line position is carried out during approximately 50° of rotation of the plate 260. A period of about one second is required for movement. During relative movement the filling stem 152 will attain its final disposition at the bottom of the cavity of the puck mold. The stem will remain centered by the bell 158 thereby to pass through the opening in the container 330. To this end, the centering bell providing an internal conical surface intercooperates with the bottom surface of the container, to guide the filling stem. The centering bell and the guide plate 160 are free to move on the guide bar 156. Thus, as the puck mold arrives at the dotted line position in FIG. 3 the centering bell likewise arrives at its dotted line position. Since the filling stem reaches the bottom of the mold filling of the same is from the bottom to the top. This manner of filling obviates against air being entrapped in the material and results in less agitation of material during filling.

The filling operation takes place during a period of approximately two seconds while the plate is moving through approximately 100° of rotation. During the filling operation the plate and puck mold descend at a continuous rate less than the rate of upward movement. The rate is dependent upon the volumetric configuration of the cavity of the puck mold. Maintaining the filling stem at a constant height below the filled level within the puck mold also enhances the fill uniformity. Following the fill cycle, the plate and puck mold continue the descent to the full line position in FIG. 3. A further period of about one second is required. The puck mold will also have rotated through a further 50°. The puck mold is now ready for discharge to conveyor 10.

During rotation and reciprocating movement of the puck mold, as described, the cylinder 130 of charging cylinder 102, under control of valve 106, is charged with lipstick pomade material from the manifold. A period of dwell follows the charging of the cylinder during which the valve rotates to communicate the cylinder and the filler assembly 104. Operation of the piston is controlled by the cam 240 and follower 242. A cam (not shown) and associated follower 350 carried by rack 164 controls valve operation.

Thus, for a period of time during which the puck mold is being raised to the dotted line position in FIG. 3 and commencing between one and two seconds before the puck mold is received on the support plate 260, the cylinder will be charged with lipstick pomade material. During this period, the rack will be in the extreme right position of movement under control of the cam. Passage 108 is in communication with the cylinder 130, through the valve 106. Flow to the cylinder is induced by the piston through movement in the suction direction. This operation is carried out throughout a period of approximately two seconds as the follower 242 moves through approximately 100° rotation. As the plate 260 puck mold approaches and finally reaches its ultimate height, the valve 106 undergoes movement between the limits 170, 172 opening communication between the charging cylinder and the filling stem 152. Valve movement is caused by return of the rack to the FIG. 3 position under any convenient control. Thus, a second cam (not shown) operating on the other side of the cam follower 350 may be utilized. The rack may also be biased to the FIG. 3 position. During the filling operation and until shortly before commencement of the refill operation the rack undergoes no change in position. Accordingly, the rack only begins to move inwardly to rotate the valve to manifold communication at a position of about 250° rotation of the plate and puck mold. Movement of the rack in either direction is carried out over a period of slightly more than one-half second and within about 30° rotation.

As the filling operation commences, piston and piston shaft 218 under control of cam 240 begins upward movement through the cylinder, displacing material, via the filling stem, into the cavity of the puck mold. A complete fill is carried out over a period of approximately two seconds during which the puck mold has descended to a position of about two-thirds its maximum height. The descent occurs over about 100° rotation.

Following filling, the piston is controlled for movement in the opposite direction. Movement is carried out throughout about 15° rotation for a period of approximately one-third of a second. Within this time frame lipstick pomade material which remains within the filling stem and passages is "sucked back" toward and into the cylinder. Through adjustment of the time duration substantially all material within the passages may be returned to the cylinder.

After a dwell period which may last from between 1½ to 2 seconds and over a further 85° rotation, the valve 106 rotates to communicate the manifold and the charging cylinder, once again. Filling of the cylinder commences following the repositioning of the valve at about 280° rotation. At about this position of rotation each puck mold will be moved to the conveyor by action of wheel 324.

From the foregoing, it will be seen that in accordance with the present invention there is provided a filling apparatus for use with a processing line which overcomes the problems and disadvantages of the prior art. The present filling apparatus is of modular construction to permit ease in and a cost savings upon necessary repair or replacement which may be carried out in connection with a single module of the overall equipment. The filling apparatus is also capable of continuous operation and increased product results. The apparatus, also, will not undergo a filling operation unless a puck mold is in position to be filled. Other factors which should be remembered as enhancing the filling operation and the production of product free of surface imperfection include the initial acceleration and speed of the fill, the continuity of the fill, the synchronization of the piston and the mold positioning mechanism, and the lack of hesitations of momentary dwell of the puck mold which results in the elimination of imperfections at the tip and along the axial length of the lipstick appearing as radial rings on the molded surface. The synchronization of the piston and the mold positioning is also important. To this end; the filling operation should be initiated after the mold attains its maximum point of elevation and at the moment of time when the puck mold begins its descent. This operation is apparent from a view of FIGS. 9 and 10.

Having described the invention with particular reference to a preferred form thereof, it will be obvious to those skilled in the art to which the invention pertains, after understanding the invention, that various changes and modifications may be made therein without departing from the spirit and scope of the invention as recited by the claims appended hereto.

Having described the invention, what is claimed is:

1. A filling apparatus for filling one after another a plurality of molds comprising a substantially continuous flow of molds with fluid material of the type which tends rapidly to set up and/or settle when not subject substantially constantly to flowing movement, said filling apparatus comprising a manifold, said manifold including an inlet to and an outlet from an elongated path, means for connecting a source of fluid material both to said inlet and said outlet whereby said fluid material after flow through an elongated path returns to said source, said connecting means including means for continuously flowing said fluid material into said inlet; at least one filling module including a stem having an inlet and an outlet, a cylinder, a piston movable in said cylinder in opposite directions between a pair of limit positions, passage means providing fluid connection between said elongated path, said inlet of said stem and said cylinder, said passage means including a cylindrical opening and having three paths directed radially of said opening at substantially equidistant spacing therearound, and wherein a first of said paths is connected to said elongated path, while a second of said paths is connected to said cylinder and a third of said paths is connected to said stem, and a valve, said valve received in and rotatable about said cylindrical opening, said valve having internal passage means providing fluid connection between selected pairs of said first, second and third paths; means controlling the movment both of said piston in said cylinder and said valve in said cylindrical opening, said controlling means functioning when said piston moves in a cylinder charging direction to provide a fluid flow through said first and second paths and when said piston moves in a cylinder discharging direction to provide a fluid flow through said second and third paths; means for supporting each said mold to be filled; and means for moving one of said support means and filling module relative to the other so that during filling of each said mold said outlet of said stem moves upwardly toward the opening of said mold, yet remains beneath the surface of said fluid material in said mold as said mold is filled.

2. The apparatus of claim 1 including an enclosure within which said filling apparatus is disposed, and heating means, said heating means also disposed in said enclosure for maintaining said fluid material at an elevated temperature to reduce, further, the tendency of said fluid material from setting up and/or settling.

* * * * *